United States Patent [19]

Owensby et al.

[11] Patent Number: 4,550,548

[45] Date of Patent: Nov. 5, 1985

[54] METHOD AND APPARATUS FOR VACUUM PACKAGING WITH PRESHRINKING

[75] Inventors: Joseph E. Owensby, Spartanburg; Jody W. Rupp, Buffalo; Frederick A. Dobbins, Lyman; Thomas E. Waldrop, Greer, all of S.C.

[73] Assignee: W. R. Grace & Co., Cryovac Div., Duncan, S.C.

[21] Appl. No.: 498,426

[22] Filed: May 26, 1983

[51] Int. Cl.[4] ..... B65B 31/00; B65B 51/32; B65B 53/06

[52] U.S. Cl. ..... 53/434; 53/442; 53/512; 53/557

[58] Field of Search ..... 53/95, 96, 433, 434, 53/442, 511, 512, 557, 388

[56] References Cited

U.S. PATENT DOCUMENTS

| | | | |
|---|---|---|---|
| 3,668,817 | 6/1972 | Bell | 53/442 |
| 3,699,742 | 10/1972 | Giraudi | 53/512 |
| 3,958,391 | 5/1976 | Kujubu | 53/434 |
| 3,965,646 | 6/1976 | Hawkins | 53/512 |
| 3,983,258 | 9/1976 | Weaver | 53/434 |
| 4,164,111 | 8/1979 | Di Bernardo | 53/434 |
| 4,457,122 | 7/1984 | Atkins et al. | 53/434 |

FOREIGN PATENT DOCUMENTS

| | | | |
|---|---|---|---|
| 2078658 | 1/1982 | United Kingdom | 53/434 |
| 2094745 | 12/1982 | United Kingdom . | |

*Primary Examiner*—Robert L. Spruill
*Assistant Examiner*—Richard M. Mudd
*Attorney, Agent, or Firm*—John J. Toney; William D. Lee, Jr.; Mark B. Quatt

[57] ABSTRACT

A method for vacuum shrink packaging a product is provided that includes the steps of placing the product in a heat shrinkable thermoplastic bag; then shrinking the bag in a heated gaseous medium, while partially constricting the mouth of the bag to cause ballooning of the bag, further provided that the constricting is selected such that shrinkage of the bag overcomes the ballooning to collapse the bag onto the product; and then placing the bag in a vacuum chamber followed by vacuumizing and in-chamber sealing, further provided that the rate of vacuumizing is limited to substantially prevent reballooning of the bag. Associated apparatus for carrying out the method is also provided.

6 Claims, 4 Drawing Figures

METHOD AND APPARATUS FOR VACUUM PACKAGING WITH PRESHRINKING

BACKGROUND OF THE INVENTION

This invention relates generally to vacuum shrink packaging and specifically to such packaging wherein shrinkage of the packaging material over a contained product is conducted before vacuum sealing the package.

It is conventional in the field of packaging articles in flexible thermoplastic film to evacuate the interior of the package both to improve the shelf life of the packaged product and to give the package a good appearance. It is also known to improve the appearance of the vacuum sealed package by using a heat shrinkable (i.e. oriented) film as envelope for the package and subjecting the vacuum sealed package to a shrinking operation in a hot water bath or a hot air tunnel in which the plastic film is heat shrunk to bring it intimately into contact with the article therein. The present invention is particularly concerned with the heat shrinking step.

It has been conventionally preferred to carry out the heat shrinking step after the vacuumizing step by submersion of the vacuum sealed package in a hot water bath. By so doing, heat transferred to the packaging film is sufficiently rapid and uniform to provide uniform shrinkage for an attractively packaged final product. It is generally considered a processing disadvantage that wet packages must be handled, however the quality of appearance of the final package achieved with hot water shrinking is considered to offset this disadvantage.

Shrinking vacuum sealed bags with hot air convection has long been utilized, such as by the use of hot air tunnels. However, this approach has not been considered totally satisfactory, primarily because of the inability to achieve sufficient heat transfer rates to heat the packaging film in areas where the film contacts the product which acts as a heat sink. Another approach involves shrinking with hot air convection during the vacuumizing step while the packaging bag is ballooned away from a contained product, this ballooning being caused by differential rates of evacuation interior of and exterior of the bag. This approach has the disadvantage that heat transfer to the bag is adversely affected by the reduced amount of air mass in the vacuum chamber which acts as an heat transfer medium. Another approach involves shrinking in-chamber using hot air convection, as before, but wherein shrinking is conducted just prior to vacuumizing with ballooning of the bag achieved by constricting the bag mouth during heating thereby elevating pressure within the bag relative to pressure exterior of the bag.

The in-chamber prevacuumizing approach, while providing generally acceptable shrink packaging results, has the disadvantage that in a multi-chamber vacuum packaging operation each vacuum chamber must be equipped with apparatus for conducting in-chamber prevacuumizing shrinkage. For example, vacuum packaging apparatus involving a plurality of vacuum chambers is representatively shown in U.S. Pat. No. 3,958,391 issued May 25, 1976 to Kujubu wherein a plurality of vacuum chambers are moved continuously around a closed path with a vacuum packaging cycle being completed within each chamber during each revolution. During a vacuum packaging cycle within each chamber, with a loosely bagged article placed therein, the chamber is vacuumized to the desired extent causing the bag to balloon away from the enclosed article followed by extraction of air from within the bag and collapse of the bag onto the article, and then the bag is sealed in-chamber under low pressure conditions.

Representative examples of prevacuum shrinking by hot air convection are disclosed in U.K. patent application No. GB2094745A published Sept. 22, 1982 to Gianelli at. al. A package is formed by placing a loaded bag of a heat shrinkable material into a vacuum chamber and operating hot air fans to circulate air over heaters within the closed chamber to apply heat to the bag which causes air trapped within the container by bag mouth restriction means to expand and balloon the container away from contact with the product so that further forced convection heat is more readily able to shrink the bag into contact with the product. The bag is then punctured in its neck area, the chamber evacuated and the bag finally sealed before venting and opening of the chamber. The bag mouth restricting means representatively comprise a resilient leaf valve biased against a counter-support to releasably hold the bag mouth closed while permitting venting of any excessive pressure build-up in the bag.

SUMMARY OF THE INVENTION

It is a primary object of the present invention to provide in vacuum shrink packaging for hot air convective shrinkage conducted prior to vacuumizing and external of the vacuum chamber, especially in conjunction with packaging apparatus involving a plurality of vacuum chambers.

Accordingly, a method for vacuum shrink packaging a product is provided that includes the steps of placing the product in a heat shrinkable thermoplastic bag; then shrinking the bag in a heated gaseous medium while partially constricting the mouth of the bag to cause ballooning of the bag, further provided that the constricting is selected such that shrinkage of the bag overcomes the ballooning to collapse the bag onto the product; and then placing the bag in a vacuum chamber followed by vacuumizing and in-chamber sealing, further provided that the rate of vacuumizing is limited to substantially prevent ballooning of the bag.

Preferably, the method is carried out continuously in conjunction with vacuum packaging a series of products, especially in conjunction with rotary vacuum packaging.

Additionally, apparatus for vacuum shrink packaging a product is provided that includes means for shrinking a heat shrinkable thermoplastic bag in a heated gaseous medium, having associated therewith means for partially constricting the mouth of the bag to cause ballooning of the bag, further provided that the constricting is selected such that shrinkage of the bag overcomes the ballooning to collapse the bag onto the product; and a vacuum chamber, separate from said shrinking means, having means for vacuumizing and in-chamber sealing with the rate of vacuumizing limited to substantially prevent ballooning of the bag.

Preferably, the apparatus further includes means for cooling the bag month in conjunction with the constricting means.

BRIEF DESCRIPTION OF THE DRAWINGS

Further details are given below with reference to the drawings wherein.

DESCRIPTION OF THE PREFERRED EMBODIMENTS

Figure 1:
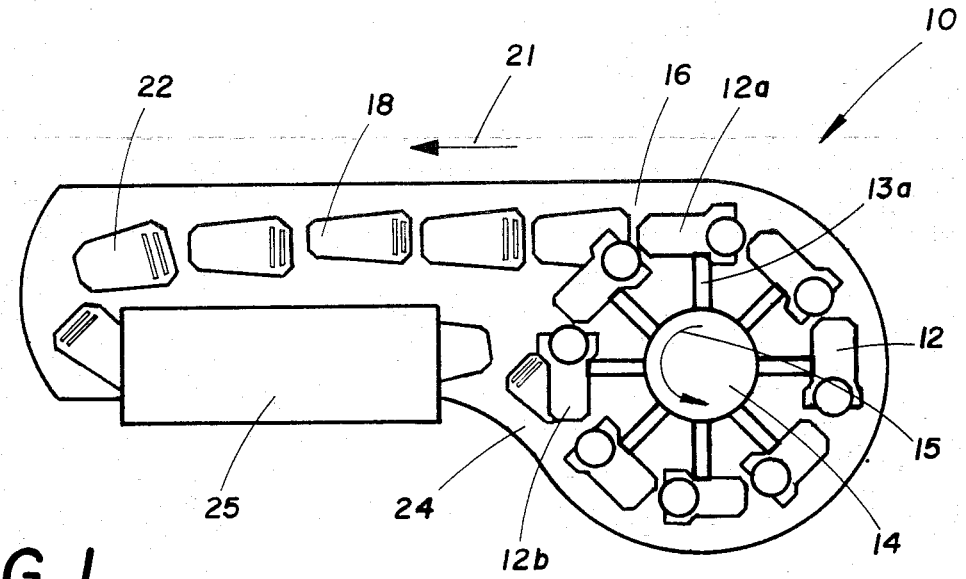
FIG. 1 is a schematic plan view of a rotary vacuum chamber packaging machine improved in accordance with an embodiment of the present invention.

Referring more particularly to the drawings, in FIG. 1 there is shown a schematic plan view of a rotary vacuum chamber packaging machine incorporating the improvement of the present invention. Conventional rotary vacuum chamber packaging machines are described in detail in U.S. Pat. No. 3,958,391 cited above and hereby incorporated by reference. Such machines operate generally according to the system depicted in FIG. 1. Rotary vacuum chamber packaging machine 10 includes a plurality of vacuum chambers, one such chamber being representatively indicated at 12, which are moved serially and continuously around a closed path in the direction indicated by arrow 15. Chamber 12*a* is shown as positioned on the closed path at location 16 where a vacuum packaging cycle is complete. At this point, the base or platen of the vacuum chamber then supporting a vacuum packaged article is separated from its vacuum chamber by being shunted away from the closed path along a shunt path progressing in the direction of arrow 21. Shunted platens move continuously along the shunt path, passing through a package discharge station located for example in the vicinity of platen 18 where the packaged article is transferred to an outfeed conveyor (not shown) by tilting the respective platen. Separation of a vacuum chamber platen from its vacuum chamber at location 16 may be accomplished by lifting the respective vacuum chamber with an integral hinged arm 13*a* stemming from a rotatively driven column 14 at the center of the closed path. The respective platen being empty after passing the discharge station continues around the shunt path to a loading station for example being located in the vicinity of platen 22 where a loosely bagged article to be vacuum packaged is placed on the moving platen. A platen such as 22 then having placed thereupon a loosely bagged article continues along the shunt path through hot air shrink tunnel 25 to synchronously merge with an empty vacuum chamber 12*b* advancing around the closed path at location 24. This merger is accomplished by an operation inverse to the shunt separation operation discussed above. At this point, a vacuum packaging cycle begins. With each revolution of a vacuum chamber around the closed path a vacuum packaging cycle is completed over the path segment that extends from location 24 around to location 16. From location 16 around to location 24 a vacuum chamber will continue to advance but will be between packaging cycles. The packaging cycle carried out within each vacuum chamber includes conventional well known steps as discussed, for example, in the above cited U.S. patent. Conventionally, these steps include vacuumizing the vacuum chamber whereupon the bag lying loosely about the contained article to be packaged first balloons away from the article and then collapses onto the contained article as evacuation of air from within the bag proceeds. Finally, the evacuated bag is heat sealed in-chamber at its open end. Significantly, the present invention differs in this regard in that ballooning is prevented during vacuumizing, as discussed below.

Figure 2:
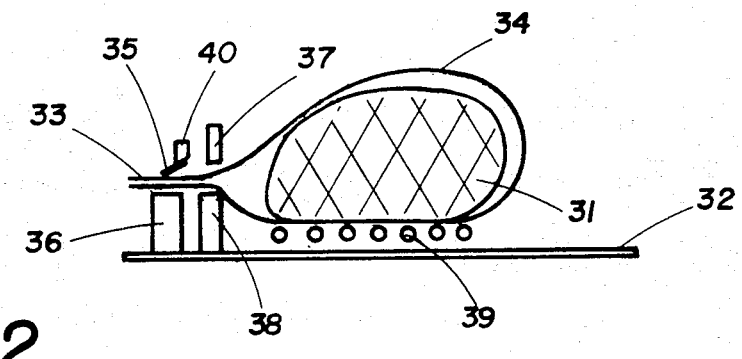
FIG. 2 is a schematic cross-sectional side view of a loosely bagged product on a vacuum chamber platen with the bag shown in the ballooned configuration while the bag neck is constricted during hot air shrinkage.

According to the present invention, the foregoing conventional rotary vacuum packaging machine is improved by the addition of the hot air shrink tunnel 25 situated over the shunt path between the loading station in the vicinity of 22 and the point at which a loaded platen exits the shunt path at 24 to merge synchronously with the respective vacuum chamber approaching location 24. In FIG. 2, a schematic cross-sectional view of a loosely bagged product 31 situated on a platen 32 moving through the hot air shrink tunnel 25 is shown in the ballooned configuration. The bag neck 33 of bag 34 is situated between a restriction flap or valve 35 on arm 40 and a cooperating valve seat 36 and between a sealing bar 37 and a seal seat 38, respectively. Preferably, the platen is provided with support rollers 39 upon which the bagged product rests so that as the bag undergoes heat shrinkage the bagged product may be freely drawn toward the restriction valve, thus exposing the entire bottom of the package to hot air. A representative restriction valve is disclosed in the above cited U.K. published patent application and is hereby incorporated by reference. The seal bar and associated seal seat are conventional as shown for example in U.S. Pat. No. 3,965,646 issued June 29, 1976 to Hawkins. Since the mode of sealing is not critical, other conventional sealers are suitable, such as an impulse sealer as representatively discussed in the above cited U.K. application. As a loosely bagged product enters the shrink tunnel 25, the air inside the bag is heated causing the bag 34 to balloon away from the product 31 since the restriction valve 35 selectively restricts expulsion of air from within the bag. With continued convective heating in the shrink tunnel, the bag is elevated to its shrink temperature at which point the shrink potential of the bag film material is released to overcome the ballooning and to collapse the bag onto the contained product. By selectively adjusting the tension on restriction valve 35, this controlled sequence of ballooning-shrinking-collapsing is accomplished. If the bag neck constriction is too extreme, then bag shrinkage will not totally overcome ballooning. On the other hand, if the constriction of the bag neck is insufficient, then ballooning of the bag over the product prior to shrinkage will be incomplete. The purpose of the ballooning is to displace the film from the cooler contained product to minimize the heat sink effect where the film contacts the product, so as to provide uniform shrinkage of the bag material. Bag shrinkage must be sufficient to intimately collapse the bag about the product surface to provide for a neatly packaged final product.

Operation of the conventional rotary vacuum chamber machine 10 is conventional in other respects with one important exception. The rate of vacuumizing within the individual vacuum chambers must be limited so as to prevent reballooning of the shrunken bag over the respective product. Otherwise, the closely conforming package configuration as achieved during preshrinking would be negated. Reballooning within a vacuum chamber is caused by an excessive rate of vacuumizing such that pressure external of the bag would be reduced at a greater rate than pressure within the bag. The smaller the chamber volume, the greater the tendency to reballoon. It is most economical in the packaging operation to minimize vacuum chamber volume thereby minimizing air mass to be evacuated. The present invention furthers this economic objective since heat shrinking apparatus is not present in the vacuum chamber, thereby approximately halving required chamber volume.

So as not to unnecessarily limit the rate of vacuumizing, the restriction valve is released during vacuumizing so that the respective bag neck is not constricted. Alternatively, though less preferred, the restriction valve may be left in the constricting configuration during vacuumizing if the bag neck is punctured, e.g. by a spike arrangement brought into contact with the bag neck upon closure of the vacuum chamber.

Figure 3:
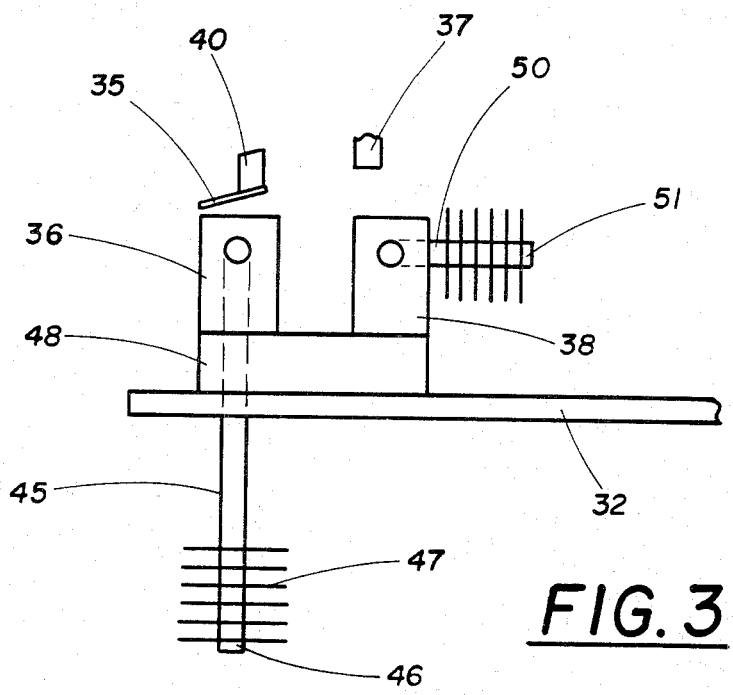
FIG. 3 schematically depicts heat pipe means for cooling the seat for a constriction valve on the platen of the previous figure and heat pipe means for heating the seal seat of a seal bar associated with the platen of the previous figure.

In FIG. 3, several preferred features according to the invention are depicted. In certain cases, the self-welding temperature of the bag material may fall within the temperature ranges achieved in the shrink tunnel. In these situations for the restriction valve to operate in accordance with the invention, self-welding of the bag neck must be prevented. In general, self-welding of the bag neck is prevented by cooling the restriction valve seat, for example by directing a cold air jet on the seat just prior to a platen entering the shrink tunnel. A preferred method, however, for cooling the restriction valve seat is to provide for cooling heat transfer from the valve seat 36 to the ambient atmosphere under the shrink tunnel 25, which as shown is accomplished by a heat pipe 45 in thermal communication with the valve seat and having its cold end 46 extending below the platen 32 and outside the shrink tunnel atmosphere. The cold end 46 of the heat pipe 45 is provided with heat transfer fins at 47. Preferably, the valve seat is thermally insulated from the platen 32 with conventional insulating material at 48. Such heat pipes are commercially available from a number of suppliers including Noren Products, Inc. of Menlo Park, Calif. The working temperature range of the heat pipe is selected as commensurate with the range of temperatures in the shrink tunnel, e.g. 200°–400° F.

Another preferred feature provides for preheating the seal seat 38 while platen 32 passes through the hot air tunnel, even though sealing is not accomplished until later after vacuumizing is complete within the respective vacuum chamber. Preheating of the seal seat 38 may be accomplished by a conventional heat pipe 50 being in thermal communication with the seal seat and having its hot end 51 above the respective platen so as to be exposed to the hot atmosphere within the shrink tunnel. Alternatively, heat transer fins may be provided directly on the seal seat in lieu of the heat pipe.

Figure 4:
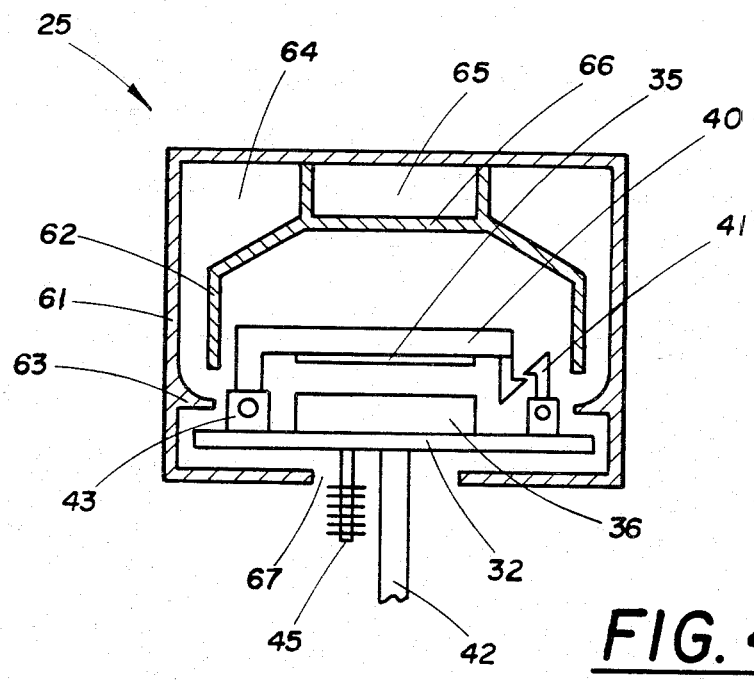
FIG. 4 is a schematic cross-sectional end view of a shrink tunnel with a vacuum chamber platen passing through the tunnel.

In FIG. 4, a cross-sectional end view of a hot air shrink tunnel in accordance with the invention is shown with a vacuum chamber platen passing through the tunnel. Tunnel 25 has insulated exterior walls 61 with a longitudinal channel 67 along the underside of the tunnel. Inside tunnel 25 there is hot air inlet plenum 64 for feeding hot air down along the sides of the tunnel with baffels 62 and 63 directing the hot air flow across the platen 32. Baffel 62 is perforated with the size of the perforations increasing toward the bottom of the tunnel. Baffel 66 is also a perforated baffel for directing air currents to return plenum 65. Platen 32 rides on support pedestal 42 which is chain driven (not shown). Longitudinal channel 67 permits passage of pedestal 42 and provides access for heat pipe 45 to the ambient atmosphere. Restriction valve seat 36 on platen 32 cooperates with restriction flap 35 which in turn is afixed to restriction arm 40. Arm 40 is spring loaded-up at pivot 43 and is retained in the down position (as shown) by latching mechanism 41. After the platen exits the shrink tunnel, restriction valve 35 is released by release of latch 41 which is spring loaded to the closed position as shown. Release of latch 41 is automatically triggered for example by the platen passing a cam that deflects latch 41 just prior to the platen entering a vacuum chamber.

As an example, smoked ring bologna was packaged in accordance with the foregoing embodiment. Packaging bags were optimally heat shrinkable at about 190°–210° F. such as type B-155 Bags from W. R. Grace & Co. which are 4-ply, grease resistant, heat shrinkable, Barrier Bags (TM). Bag dimensions were about 7 inches width by 12 inches length. The preshrink hot air tunnel was of the side-drafted type, as above. The tunnel was operated in the temperature range of about 350°–400° F. at an air velocity of about 1,000–1,500 feet per minute. Transit time through the tunnel (pre-shrink time) for a given package was about 2.5 seconds at a packaging rate of about 60 packages per minute. The restriction valve was a silicone rubber flap having a hardness of about 60 Shore (A) and dimensions of ⅛ inch thickness, 7 inches width (corresponding to the bag width) and 1 inch length. The degree of restriction was adjusted by the angle of contact of the rubber flap with the bag neck, an angle of about 45° being found to produce a satisfactory balloon-shrink-collapse sequence under these tunnel conditions. Pre-shrunk packages were then vacuumized using a rotary vacuum chamber machine, each vacuum chamber having about one cubic foot internal volume and being vacuumized over a period of about three seconds with the restriction valve released, this rate of vacuumizing being limited sufficiently to prevent reballooning, so that attractive vacuum packages resulted.

Although the present invention has been described in conjunction with perferred embodiments, it is to be understood that modifications and variations may be utilized without departing from the principles and scope of the invention, as those skilled in the art will readily understand. Accordingly, such modifications and variations may be practiced within the scope of the following claims:

What is claimed is:

1. A method for continuously packaging products comprising:

(a) placing a product in a heat shrinkable thermoplastic bag; then (b) shrinking said bag in a heated gaseous medium while (c) partially constricting the mouth of said bag to cause ballooning of said bag, further provided that said constricting is selected such that shrinkage of said bag overcomes said ballooning to collapse said bag onto said product;

(d) cooling the mouth of said bag during said constricting of the mouth sufficiently to prevent self-welding of the bag material to itself; and then (e) placing said bag in a vacuum chamber followed by vacuumizing and in-chamber sealing, further provided that the rate of vacuumizing is limited to substantially prevent ballooning of said bag.

2. Apparatus for continuously vacuum packaging a product, comprising:

(a) means for shrinking a heat shrinkable thermoplastic bag in a heated gaseous medium; having associated therewith (b) means for partially constricting the mouth of said bag to cause ballooning of said bag, further provided that said constricting is selected such that shrinkage of said bag overcomes said ballooning to collapse said bag onto said product;

(c) means for cooling the mouth of said bag in conjunction with said constricting means; and, (d) a vacuum chamber, separate from said shrinking means, having means for vacuumizing and in-chamber sealing further provided that the rate of vacuumizing is limited to substantially prevent ballooning of said bag.

3. The appartus of claim 2 further comprising means for operating said shrinking means continuously in conjunction with means for vacuum packaging a series of products.

4. The apparatus of claim 2 wherein said vacuum packaging means comprise a rotary vacuum packaging machine.

5. The apparatus of claim 2 wherein said shrinking means comprise a side-drafted hot air tunnel.

6. The apparatus of claim 2 wherein said constricting means comprise a resilient flap of adjustable flexure.

* * * * *

UNITED STATES PATENT AND TRADEMARK OFFICE

CERTIFICATE OF CORRECTION

PATENT NO. : 4,550,548

DATED : November 5, 1985

INVENTOR(S) : Joseph E. Owensby, Jody W. Rupp, Frederick A. Dobbins, Thomas E. Waldrop It is certified that error appears in the above-identified patent and that said Letters Patent is hereby corrected as shown below:

In column 8, line 4, delete "appartus"
substituting therefor --apparatus--

Signed and Sealed this

*Third* Day of *June 1986*

[SEAL]

*Attest:*

DONALD J. QUIGG

*Attesting Officer*

*Commissioner of Patents and Trademarks*